US007371095B2

(12) United States Patent
Takahashi

(10) Patent No.: US 7,371,095 B2
(45) Date of Patent: May 13, 2008

(54) CONNECTOR EASILY ADAPTED TO MINIATURIZATION

(75) Inventor: Takeshi Takahashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/888,197

(22) Filed: Jul. 31, 2007

(65) Prior Publication Data

US 2008/0032526 A1 Feb. 7, 2008

(30) Foreign Application Priority Data

Aug. 3, 2006 (JP) ..... 2006-211678
Oct. 4, 2006 (JP) ..... 2006-273323

(51) Int. Cl.
*H01R 13/15* (2006.01)
*H01R 13/62* (2006.01)

(52) U.S. Cl. ..... 439/261; 439/310; 439/607; 439/157

(58) Field of Classification Search ..... 439/157, 439/159, 261, 310, 364, 607, 259, 260, 262
See application file for complete search history.

(56) References Cited

U.S. PATENT DOCUMENTS 4,560,216 A * 12/1985 Egawa ..... 439/41
5,326,271 A * 7/1994 Kishi et al. ..... 439/72
5,399,103 A * 3/1995 Kuboshima et al. ..... 439/509
5,429,519 A * 7/1995 Murakami et al. ..... 439/310
6,428,338 B1 * 8/2002 Yasufuku et al. ..... 439/310
6,544,061 B1 * 4/2003 Yasufuku et al. ..... 439/310
2003/0166354 A1 9/2003 Tsing
2006/0166541 A1 7/2006 Uchida et al.

FOREIGN PATENT DOCUMENTS

EP 1 355 384 10/2003
JP 5335617 12/1993
JP 2000/082826 3/2000

OTHER PUBLICATIONS

European Search Report dated Nov. 21, 2007.

* cited by examiner

*Primary Examiner*—James Harvey
(74) *Attorney, Agent, or Firm*—Collard & Roe, P.C.

(57) ABSTRACT

A connector includes a cover adapted to push a connection object toward a first contact. The first contact includes a first contact portion to be connected to a contact portion of the connection object. A second contact includes a second contact portion and a locking portion. The cover includes a cover contact portion held by the housing so as to be rotatable between opened and closed positions and to be connected to a shell of the connection object, a connecting portion to be connected to the second contact portion of the second contact, and a to-be-locked portion adapted to engage the locking portion of the second contact. At the time of the connection to the connection object, the shell of the connection object and the second contact are connected to each other through the cover contact portion, the connecting portion, and the to-be-locked portion of the cover.

12 Claims, 15 Drawing Sheets

CONNECTOR EASILY ADAPTED TO MINIATURIZATION

This application is based upon and claims the benefit of priorities from Japanese patent applications No. 2006-211678, filed on Aug. 3, 2006 and No. 2006-273323, filed on Oct. 4, 2006, the disclosures of which are incorporated herein in their entirety by reference.

BACKGROUND OF THE INVENTION

This invention relates to a connector that establishes a connection to a connection object using its openable and closable cover.

With the recent miniaturization and multifunctionality of portable electronic devices, there have been required miniaturization of electronic components and an increase in the number and speed of signal lines. These requirements can be satisfied using optical fibers or the like, which, however, naturally requires conversion from optical signals to electrical signals.

For example, Japanese Unexamined Patent Application Publication (JP-A) No. H05-335617 discloses an optical transmission module that converts an optical signal to an electrical signal. Generally, this type of optical transmission module is too large in size to be mounted in a portable device as a connector. Further, since it has pin-shaped terminals, it is necessary to form contact holes in a board. There is also a problem in terms of ensuring shielding.

Further, Japanese Unexamined Patent Application Publication (JP-A) No. 2000-82826 discloses an optical transmission socket module. Since this optical transmission socket module also has pin-shaped terminals, it is necessary to form contact holes in a board. Since this causes a limitation in board wiring, there arises an inconvenience in terms of design particularly in a miniaturized portable device. Further, even if a connector can be disposed on a board, there still arises a problem that the height increases. In addition, if an optical transmission socket module is miniaturized, it is difficult to attach and detach the optical transmission socket module to and from a board because handling thereof is complicated. Further, there is also a problem that it is difficult to achieve sufficient shielding.

SUMMARY OF THE INVENTION

It is therefore an exemplary object of this invention to provide a connector capable of easy adaptation to miniaturization.

It is another exemplary object of this invention to provide a connector capable of easily achieving shielding and yet capable of facilitating a connecting operation.

Other objects of the present invention will become clear as the description proceeds.

According to an exemplary aspect of the present invention, there is provided a connector for connection to a connection object, comprising a first contact, a second contact, a housing holding the first contact and the second contact, and a cover adapted to push the connection object toward the first contact, wherein the first contact comprises a first contact portion adapted to be connected to a contact portion of the connection object, wherein the second contact comprises a second contact portion and a locking portion, wherein the cover comprises a cover contact portion held by the housing so as to be rotatable between an opened position and a closed position and adapted to be connected to a shell of the connection object, a connecting portion adapted to be connected to the second contact portion of the second contact, and a to-be-locked portion adapted to engage the locking portion of the second contact, and wherein at the time of the connection to the connection object, the shell of the connection object and the second contact are connected to each other through the cover contact portion, the connecting portion, and the to-be-locked portion of the cover.

According to another exemplary aspect of the present invention, there is provided a connector for connection to a connection object, comprising a contact, a housing holding the contact, a cover adapted to push the connection object toward the contact, and a locking portion for locking the cover, wherein the cover is held by the housing so as to be rotatable between an opened position and a closed position and comprises a to-be-locked portion that engages the locking portion when the cover is rotated to the closed position and then caused to slide, wherein one of the housing and the cover comprises a shaft portion and the other of the housing and the cover comprises a shaft hole inserted with the shaft portion, wherein the shaft portion is cylindrical in shape and has a chamfered portion, wherein the shaft hole comprises a first hole that serves for rotation of the cover and is inserted with the shaft portion, a second hole that is inserted with the shaft portion when the cover is caused to slide, and a connecting portion connecting the first hole and the second hole to each other and having a width smaller than either of a diameter of the first hole and a diameter of the second hole, and wherein the connecting portion inhibits movement of the cover when the cover is at the opened position, while allows the cover to slide cooperatively with the chamfered portion when the cover is at the closed position.

DESCRIPTION OF THE PREFERRED EMBODIMENTS

Figure 1A:
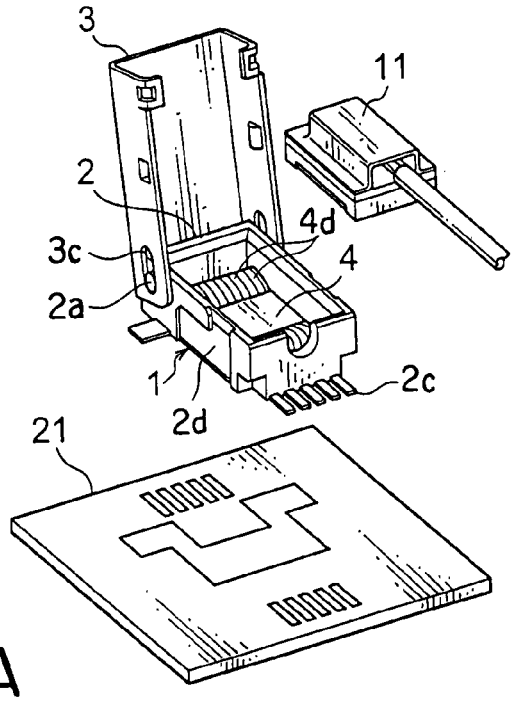
FIG. 1A is a perspective view showing a connector according to a first exemplary embodiment of this invention, along with a board and an optical module.

Referring to FIGS. 1A to 3, a description will be given of a connector according to a first exemplary embodiment of this invention, along with a board and an optical module.

This connector is depicted by reference numeral 1. The connector 1 is a socket connector used for connecting an optical module 11, adapted for conversion between an optical signal and an electrical signal, to a board 21 in the form of an FPC (Flexible Printed Circuit) or the like.

In FIG. 1A, the socket connector 1 comprises an insulating housing 2 and a conductive cover 3 that can open and close the housing 2. The housing 2 is open at its top and a low contact pressure connector 4 as a relay component is inserted from this open top so as to be disposed in the housing 2. The housing 2 is attached with a conductive ground terminal 2*d* extending over the bottom and both sides thereof.

In FIG. 1A, the optical module 11 is not yet set in the housing 2 and the socket connector 1 is not yet mounted on the board 21. The housing 2 is made of resin and the cover 3 is made of metal.

Figure 1B:
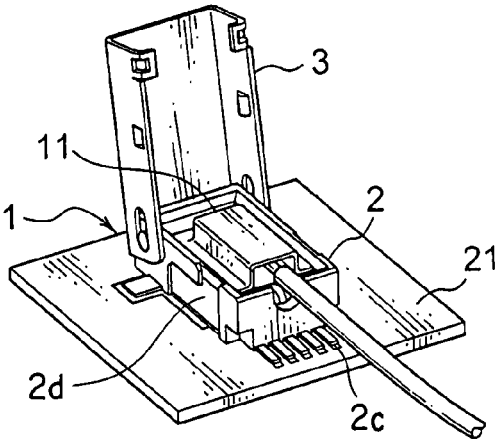
FIG. 1B is a perspective view showing a state of the connector mounted on the board before the optical module is connected thereto.

In FIG. 1B, the socket connector 1 is mounted on the board 21. The optical module 11 is set in the housing 2, but is not connected or fitted to the socket connector 1 because of the cover 3 being opened.

Figure 1C:
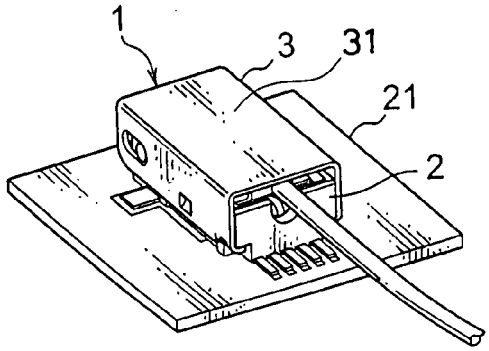
FIG. 1C is a perspective view showing a state of the connector mounted on the board after the optical module is connected thereto.
Figure 2:
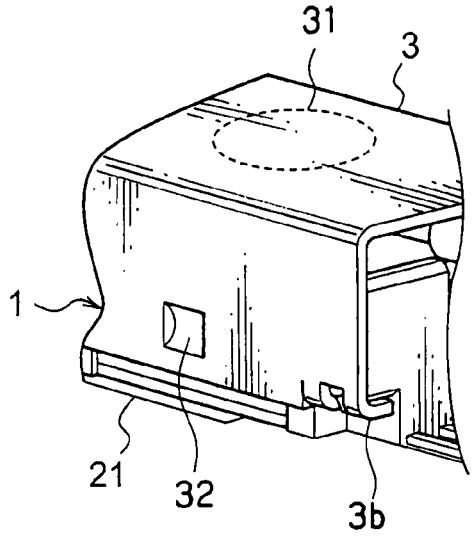
FIG. 2 is an enlarged perspective view of a main portion of FIG. 1C.

In FIGS. 1C and 2, the cover 3 is closed with respect to the housing 2. Accordingly, the optical module 11 is connected to the socket connector 1. At the time of the connection, a contact portion 31 of the cover 3 contacts the optical module 11 and, further, contact portions 32 in the form of inward projections on both sides of the cover 3 contact the ground terminal 2*d*.

Figure 3:
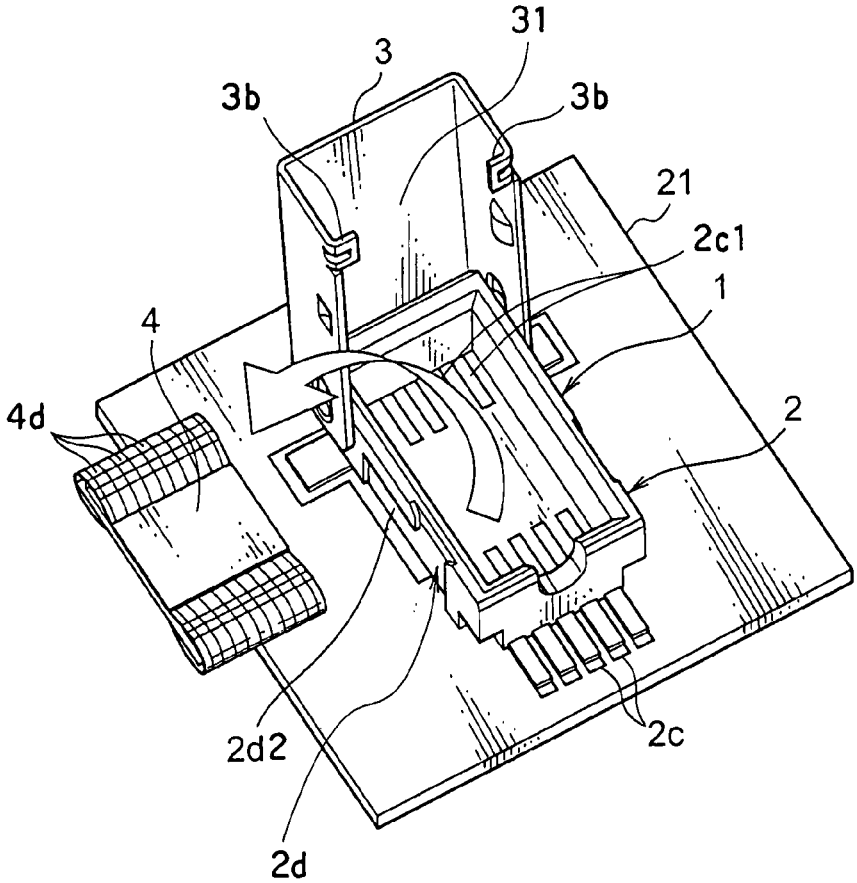
FIG. 3 is a perspective view showing a partially disassembled state of the connector mounted on the board.

In FIG. 3, the cover 3 is opened with respect to the housing 2 and the low contact pressure connector 4 is removed from the housing 2. The housing 2 has a rectangular frame shape. At bottom portions of the housing 2 at its both ends in a longitudinal direction thereof, terminals 2*c* are held by the housing 2 at a predetermined pitch, the number of terminals 2*c* being five at each of the longitudinal ends of the housing 2. The ground terminal 2*d* also serves to reinforce soldering of the terminals 2*c* to the board 21. The ground terminal 2*d* is connected to the board 21 by soldering.

On the other hand, the low contact pressure connector 4 has five conductive belt-shaped terminals 4*d* arranged at the predetermined pitch corresponding to the terminals 2*c*. The terminals 4*d* are exposed at least at both ends of the low contact pressure connector 4. Thus, when the low contact pressure connector 4 is placed in the housing 2, the terminals 4*d* contact the terminals 2*c*, respectively. The low contact pressure connector 4 will be described in detail later.

Figure 4A:
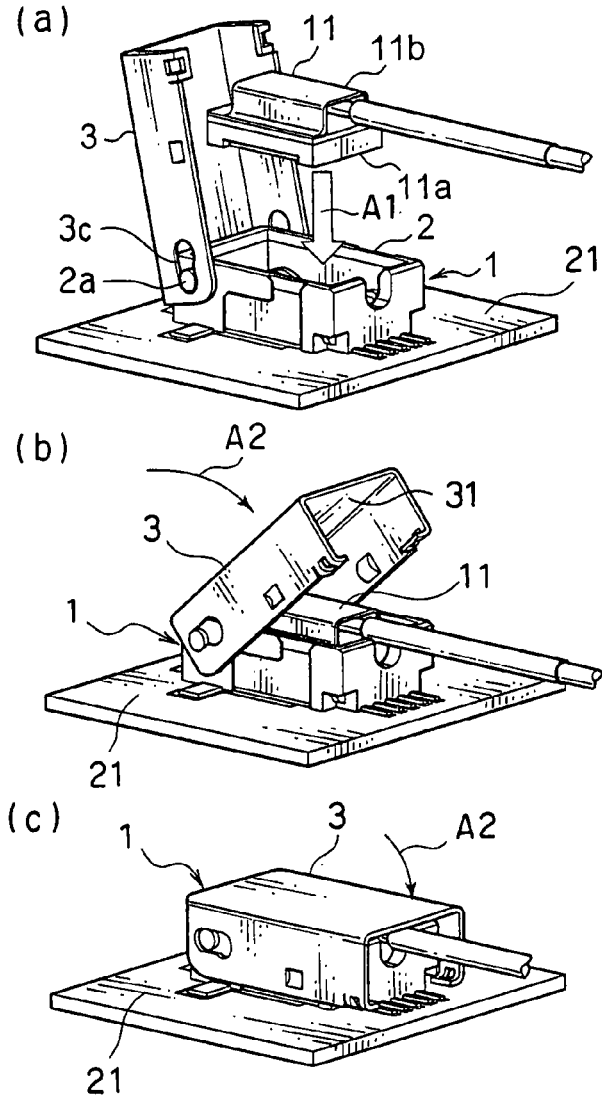
FIG. 4A is a diagram for explaining a connection sequence of the connector.
Figure 4B:
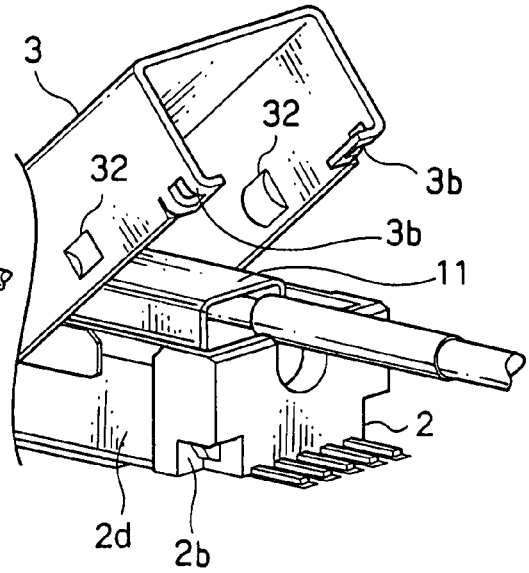
FIG. 4B is an enlarged perspective view of a main portion of a connection state shown at (b) in FIG. 4A.

Referring to FIG. 4A, a description will be given of a sequence of connecting the optical module 11 to the socket connector 1.

At first, as shown at (a) in FIG. 4A, the optical module 11 is set into the housing 2 in a direction of arrow A1. The optical module 11 has a contact portion 11*a* for forwarding/receiving an electrical signal and a shell 11*b* covering the contact portion 11*a*. At bottom portions of the optical module 11 at its both ends in a longitudinal direction thereof, the contact portion 11*a* has terminal portions arranged at the predetermined pitch corresponding to the terminals 4*d* of the low contact pressure connector 4, the number of terminal portions being five at each of the longitudinal ends of the optical module 11. The shell 11*b* is electrically isolated from the contact portion 11*a*, while it is electrically connected to ground (not shown) of the board 21 through the ground terminal 2*d* according to a structure which will be described later.

When setting the optical module 11 in the housing 2, no load is required. Therefore, the socket connector 1 is a so-called zero insertion force connector. Further, as will be described later, when detaching the optical module 11 from the socket connector 1, the optical module 11 can be detached only by opening the cover 3 and no extraction or unmating force is required. Positioning of the optical module 11 with respect to the housing 2 is carried out based on the external shape of the optical module 11 and the internal shape of the housing 2.

Then, when the cover 3 is turned in a direction of arrow A2 from the position shown at (b) in FIG. 4A to the position shown at (c) in FIG. 4A, the contact portion 31 of the cover 3 contacts the shell 11*b* of the optical module 11. In this event, the contact portions 32 of the cover 3 contact the ground terminal 2*d*. In this manner, the shell 11*b* of the optical module 11 is electrically connected to the board 21 through the cover 3 and the ground terminal 2*d* so as to be grounded.

Figure 4C:
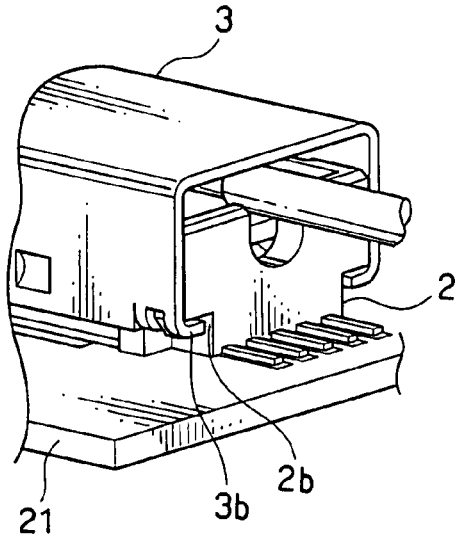
FIG. 4C is an enlarged perspective view of a main portion of a connection state shown at (d) in FIG. 4A.

Subsequently, when the cover 3 is caused to slide in a direction of arrow A3 shown at (d) in FIG. 4A, elongated holes 3*c* serving as shaft holes formed on both sides of the cover 3 are respectively guided by guide pins or shaft portions 2*a* provided on both sides of the housing 2. Then, as also shown in FIG. 4C, to-be-locked portions 3*b* of the cover 3 engage locking portions 2*b* of the housing 2. In this event, the to-be-locked portions 3*b* of the cover 3 also engage locking portions 2*d*2*a* of the ground terminal 2*d* shown in FIG. 7.

Figure 5B:
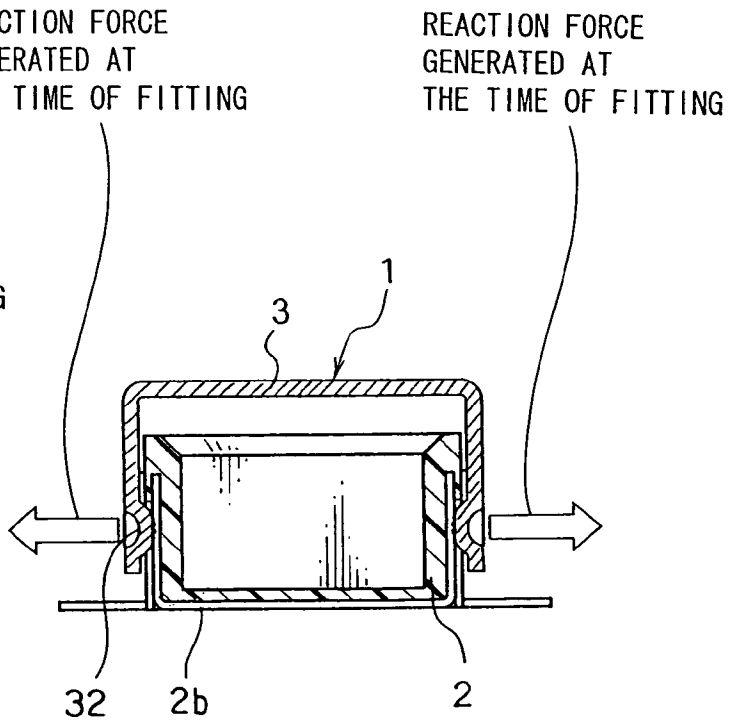
FIG. 5B is a sectional view, taken along line Vb-Vb in FIG. 5A, with an internal mechanism omitted.
Figure 5A:
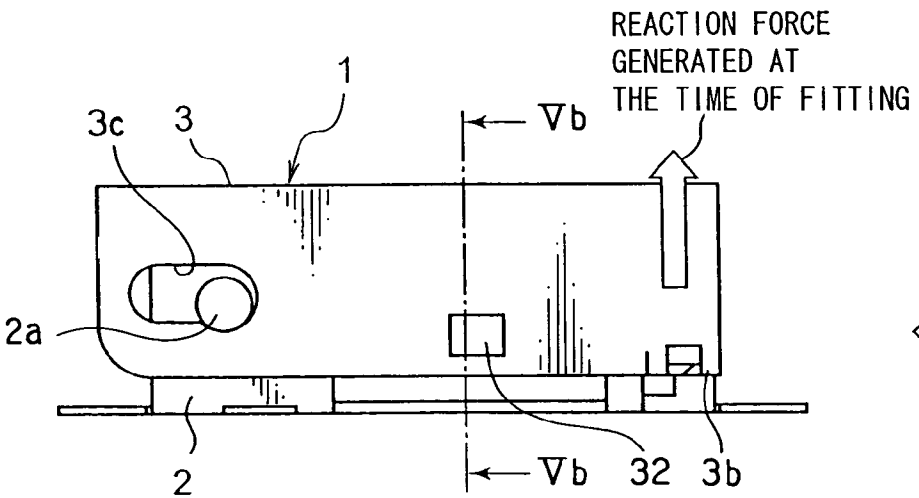
FIG. 5A is a side view of the connector.
Figure 7:
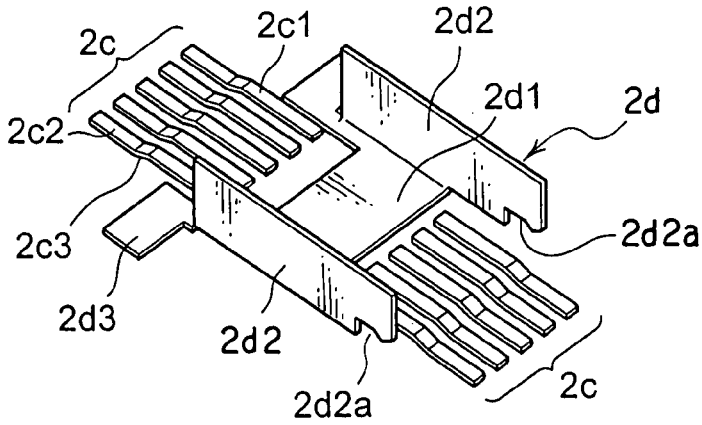
FIG. 7 is a perspective view showing details of terminal components incorporated in the connector.

As a result, the ground terminal 2*d* contacts the cover 3 at a total of four portions thereof, i.e. at its two locking portions 2*d*2*a* and its two second contact portions 2*d*2 shown in FIG. 7. Further, since the contact between the ground terminal 2*d* and the cover 3 in the connected state is ensured by reaction forces generated in two directions, i.e. vertical and horizontal directions, at the time of the fitting thereof as shown in FIGS. 5A and 5B, the shell 11*b* of the optical module 11 is reliably grounded.

Figure 6:
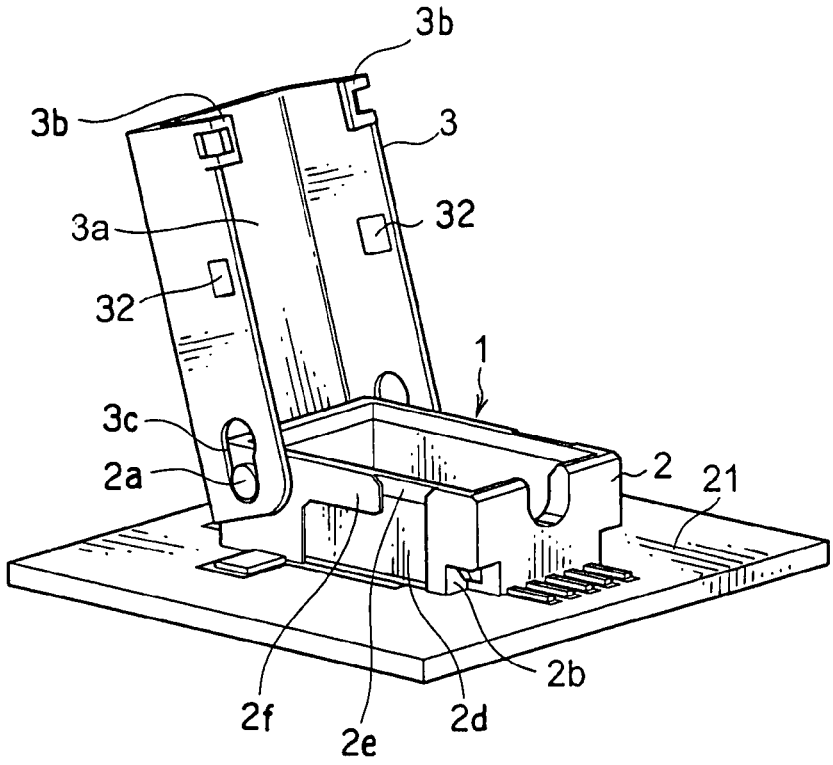
FIG. 6 is an enlarged perspective view showing a state of the connector mounted on the board.

Referring also to FIG. 6, the housing 2 will be further described.

The housing 2 has guide portions 2*e* and projecting portions 2*f* formed near the guide portions 2*e*, respectively. As the cover 3 is closed, the contact portions 32 pass through the guide portions 2*e* and reach the positions where they contact the ground terminal 2*d*. Thereafter, when the cover 3 is caused to slide in the direction of arrow A3 shown at (d) in FIG. 4A, at least part of each contact portion 32 enters under the corresponding projecting portion 2*f*. Thus, each projecting portion 2*f* serves to receive a vertical reaction force generated at the time of the fitting.

Referring also to FIG. 7, the terminals 2*c* and the ground terminal 2*d* will be described.

Each terminal 2*c* is integrally formed by a first contact portion 2*c*1, a first terminal portion 2*c*2, and an inclined portion 2*c*3 connecting both portions 2*c*1 and 2*c*2 to each other. The first contact portions 2*c*1 of the terminals 2*c* are adapted to contact the terminals 4*d* of the low contact pressure connector 4, respectively. The first terminal portions 2*c*2 of the terminals 2*c* are soldered to the board 21.

On the other hand, the ground terminal 2*d* is integrally formed by a middle portion 2*d*1, the second contact portions 2*d*2 perpendicular to the middle portion 2*d*1 on both sides thereof, and second terminal portions 2*d*3 extending from both ends of the middle portion 2*d*1 for connection to the board 21. The terminals 2*c* and the ground terminal 2*d* are press-fitted to the housing 2 or insert-molded with the housing 2.

Figure 8:
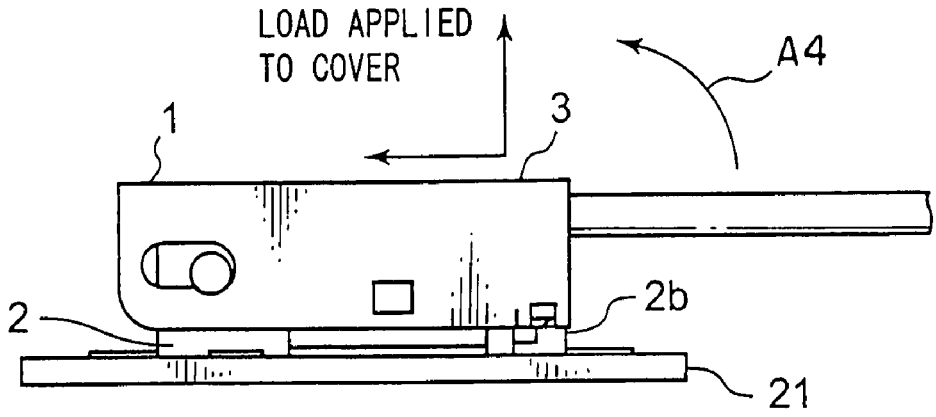
FIG. 8 is a side view for explaining the dynamic relationship when a moment load is applied to the optical module connected to the connector.

Referring also to FIG. 8, a description will be given of the dynamic relationship when a moment load is applied to the optical module 11.

It is assumed that a moment load is applied to the optical module 11 in a direction of curved arrow A4. In that case, a load applied to the cover 3 is a resultant force which is the sum of horizontal and vertical components of force. Since the horizontal component of force is oriented in the direction of arrow A3 shown at (d) in FIG. 4A, the to-be-locked portions 3*b* of the cover 3 are prevented from being disengaged from the locking portions 2*b* of the housing 2 or the locking portions 2*d*2*a* of the ground terminal 2*d*.

Figure 9:
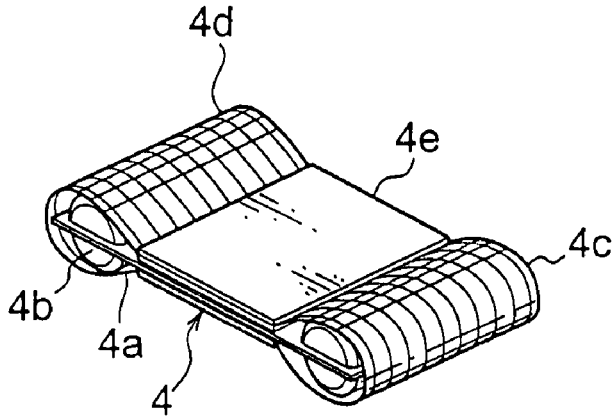
FIG. 9 is an enlarged perspective view of a low contact pressure connector used as a relay component in the connector.

Referring to FIG. 9, the low contact pressure connector 4 will be further described.

The low contact pressure connector 4 includes a center plate 4*a*, four elastic semicylindrical members 4*b* disposed on the front and back surfaces of the center plate 4*a* at its both ends, and an insulating sheet 4*c* surrounding the center plate 4*a* and the four semicylindrical members 4*b*. The foregoing five belt-shaped terminals 4*d* are attached to the insulating sheet 4*c* so as to be wound around it at the predetermined pitch. The low contact pressure connector 4 further includes two insulating plates 4*e* sandwiching therebetween the insulating sheet 4*c* and the terminals 4*d* from the upper and lower sides at a portion between the two pairs of semicylindrical members 4*b*.

Figure 10:
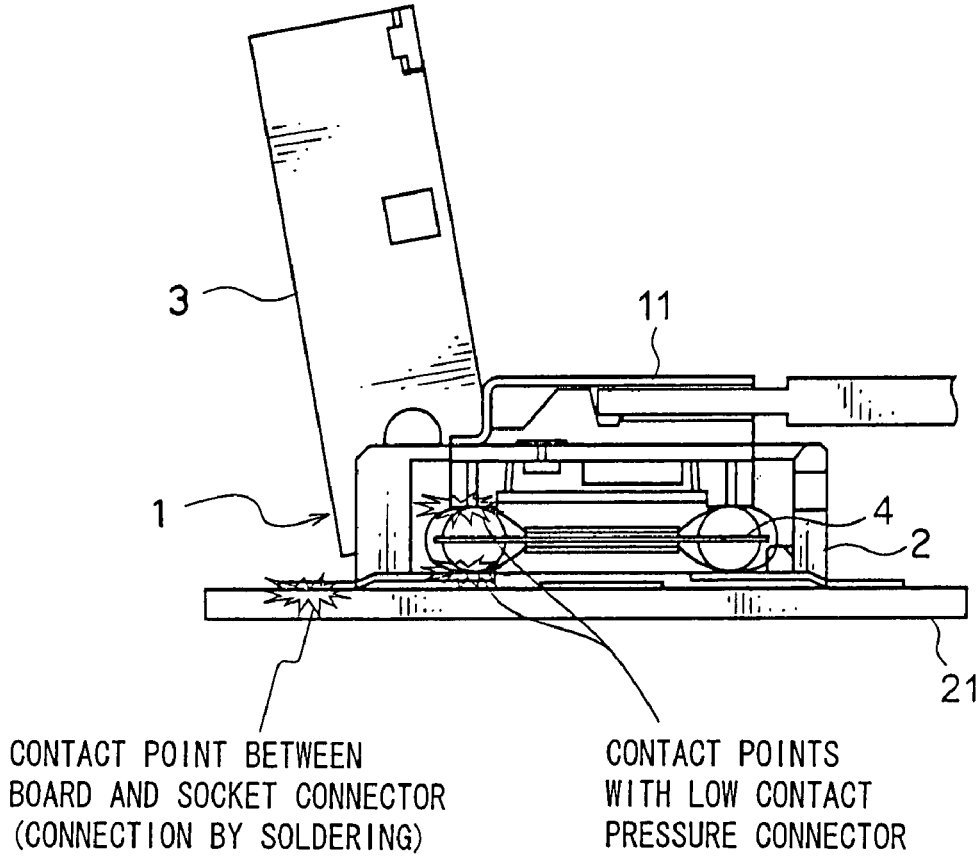
FIG. 10 is a side view for explaining the connection relationship of the connector.

Referring also to FIG. 10, the manner of using the socket connector 1 will be described.

The connection between the optical module 11 and the board 21 is achieved through the low contact pressure connector 4. That is, when the optical module 11 is fitted to the socket connector 1, the semicylindrical members 4*b* of the low contact pressure connector 4 are pushed by the optical module 11 so as to be elastically deformed and, following it, the contact portion 11*a* of the optical module 11 is electrically connected to the first contact portions 2*c*1 of the terminals 2*c*, soldered to the board 21, through the terminals 4*d* of the low contact pressure connector 4.

Using the foregoing low contact pressure connector 4, it is possible to provide the connector 1 that is small in size, simple in structure, and easy in connecting operation. Incidentally, the optical module 11 is formed by optical fibers, prisms, light-receiving elements, photoelectric conversion elements, and a ceramic substrate and conductor portions for pattern formation.

Referring to FIGS. 11A to 13, a description will be given of a connector according to a second exemplary embodiment of this invention. Explanation of those portions that are the same as those in the foregoing first exemplary embodiment may be omitted by assigning the same reference symbols thereto.

This connector is also depicted by reference numeral 1. The connector 1 is a socket connector used for connecting an optical module 11, adapted for conversion between an optical signal and an electrical signal, to a board in the form of an FPC or the like.

Figure 11A:
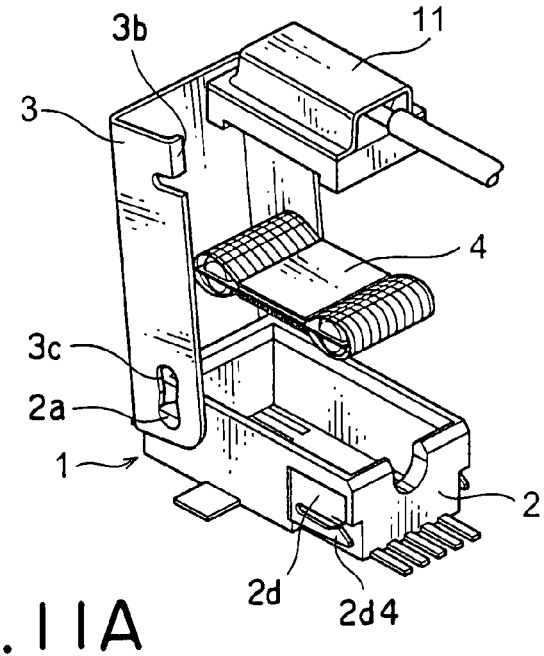
FIG. 11A is an exploded perspective view showing a connector according to a second exemplary embodiment of this invention, along with an optical module.

In FIG. 11A, second contact portions 2*d*2 of a ground terminal 2*d* attached to a housing 2 have elastically deformable contact strips 2*d*4, respectively. The contact strips 2*d*4 are exposed to the outside near locking portions 2*b* of the housing 2. On the other hand, to-be-locked portions 3*b* of a cover 3 are each formed in a plate shape.

In FIG. 11A, the housing 2 is open at its top, but a low contact pressure connector 4 as a relay component and the optical module 11 are not yet set in the housing 2. Further, the socket connector 1 is not yet mounted on the board.

Figure 11B:
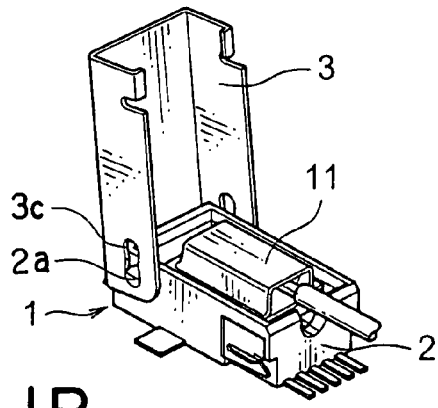
FIG. 11B is a perspective view showing a state of the connector before the optical module is connected thereto.

In FIG. 11B, the optical module 11 is set in the housing 2 through the low contact pressure connector 4. However, since the cover 3 is opened, the optical module 11 is not connected or fitted to the socket connector 1.

Figure 11C:
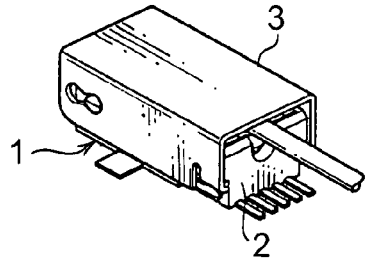
FIG. 11C is a perspective view showing a state of the connector after the optical module is connected thereto.
Figure 12:
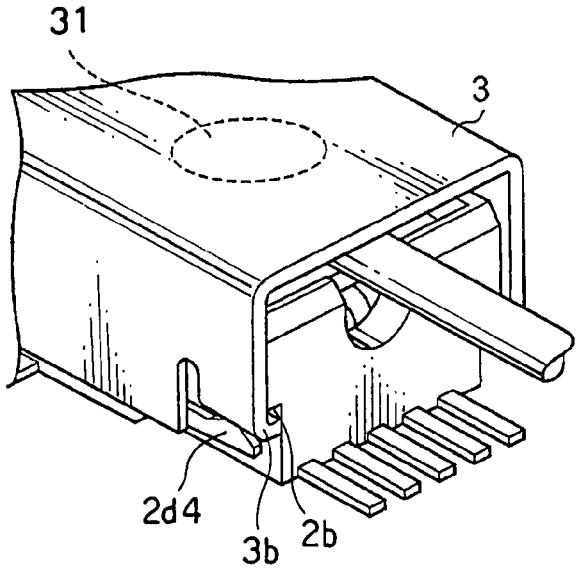
FIG. 12 is an enlarged perspective view of a main portion of FIG. 11C.

In FIGS. 11C and 12, the cover 3 is closed with respect to the housing 2. Accordingly, the optical module 11 is connected to the socket connector 1. At the time of the connection, the to-be-locked portions 3*b* of the cover 3 engage the locking portions 2*b* of the housing 2 and, further, contact the contact strips 2*d*4 of the ground terminal 2*d*.

Figure 13:
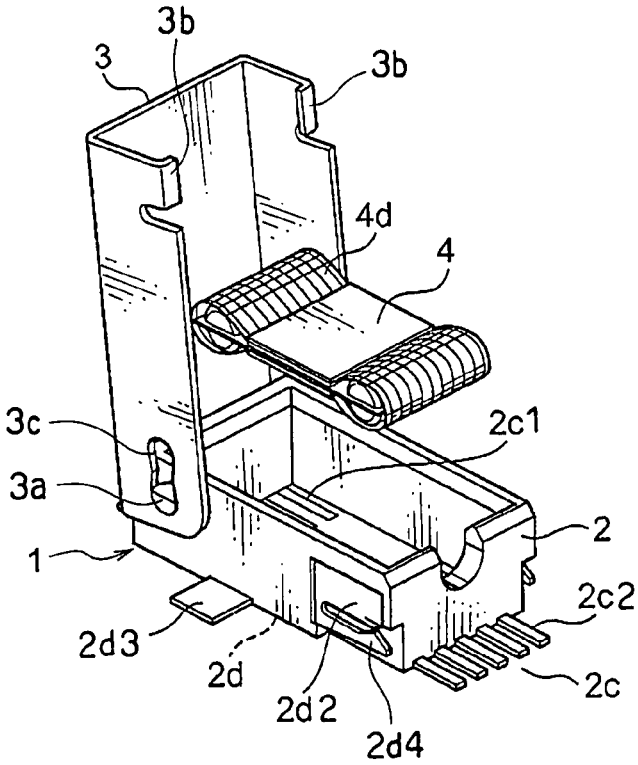
FIG. 13 is an exploded perspective view of the connector.

In FIG. 13, the cover 3 is opened with respect to the housing 2 and the low contact pressure connector 4 is removed from the housing 2. The housing 2 has a rectangular frame shape. At bottom portions of the housing 2 at its both ends in a longitudinal direction thereof, terminals 2*c* are held by the housing 2 at a predetermined pitch, the number of terminals 2*c* being five at each of the longitudinal ends of the housing 2. The ground terminal 2*d* also serves to reinforce soldering of the terminals 2*c* to the board. The ground terminal 2*d* is connected to the board by soldering its second terminal portions 2*d*3 to the board. When the low contact pressure connector 4 is placed in the housing 2, its terminals 4*d* contact the terminals 2*c*, respectively.

Further, guide pins or shaft portions 2*a* projecting from both side surfaces of the housing 2 are inserted into elongated holes 3*c*, serving as shaft holes, formed in the cover 3. In this manner, the cover 3 is pivotable relative to the housing 2 about the shaft portions 2*a* serving as fulcrums.

Figure 14A:
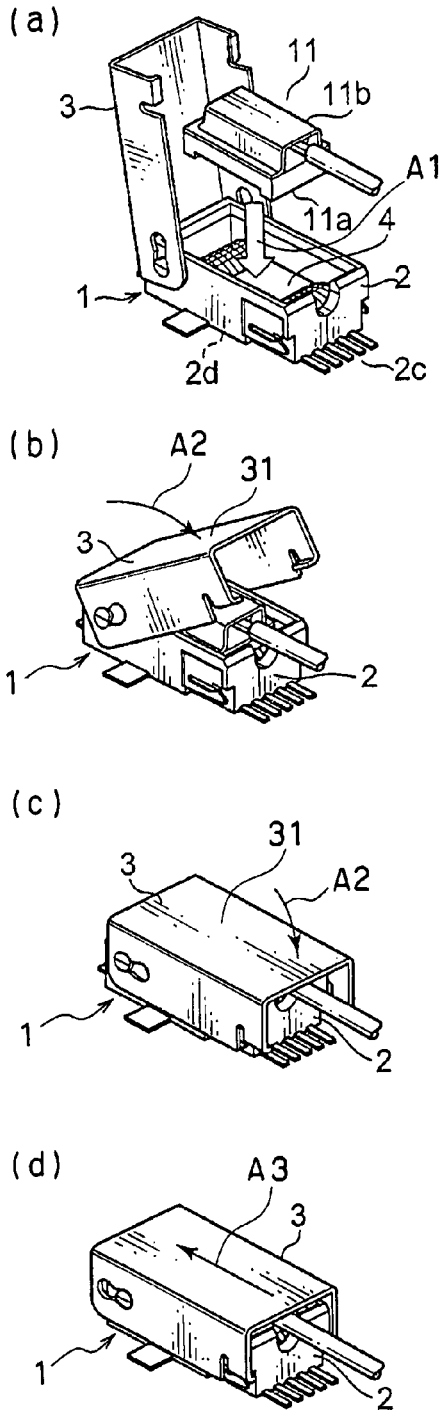
FIG. 14A is a diagram for explaining a connection sequence of the connector.
Figure 14B:
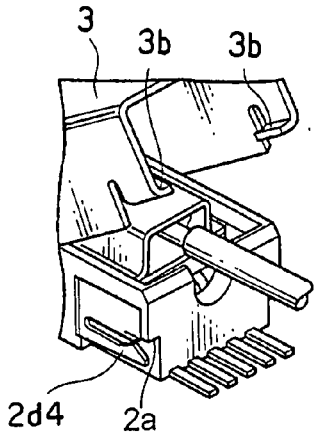
FIG. 14B is an enlarged perspective view of a main portion of a connection state shown at (b) in FIG. 14A.

Referring to FIG. 14A, a description will be given of a sequence of connecting the optical module 11 to the socket connector 1.

At first, as shown at (a) in FIG. 14A, the optical module 11 is set into the housing 2 in a direction of arrow A1. When setting the optical module 11 in the housing 2, no load is required. Therefore, the socket connector 1 is a so-called zero insertion force connector. Further, when detaching the optical module 11 from the socket connector 1, the optical module 11 can be detached only by opening the cover 3 and no extraction force is required. Positioning of the optical module 11 with respect to the housing 2 is carried out based on the external shape of the optical module 11 and the internal shape of the housing 2.

Then, when the cover 3 is turned in a direction of arrow A2 from the position shown at (b) in FIG. 14A to the position shown at (c) in FIG. 14A, a contact portion 31 of the cover 3 contacts a shell 11*b* of the optical module 11.

Figure 14C:
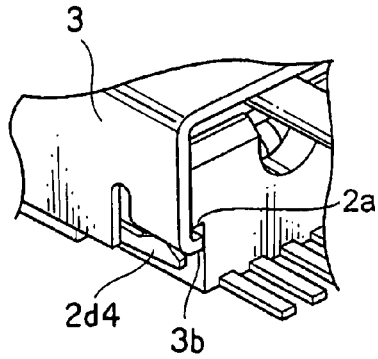
FIG. 14C is an enlarged perspective view of a main portion of a connection state shown at (d) in FIG. 14A.
Figure 15A:
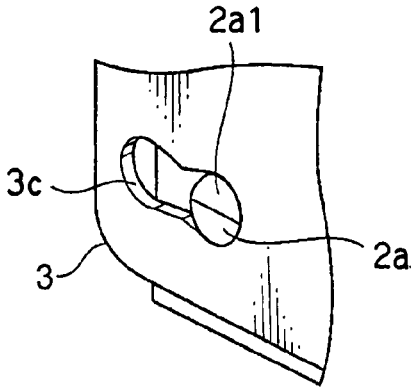
FIG. 15A is an enlarged perspective view of a main portion of the connector in the state shown at (c) in FIG. 14A.
Figure 15D:
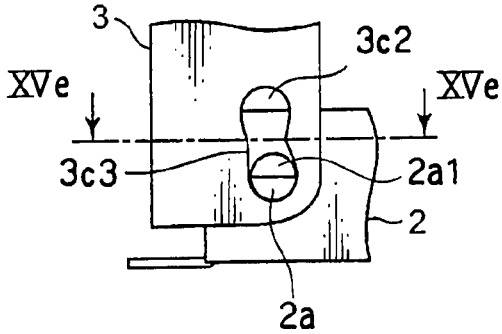
FIG. 15D is an enlarged side view of a main portion of the connector in the state shown at (a) in FIG. 14A.
Figure 15B:
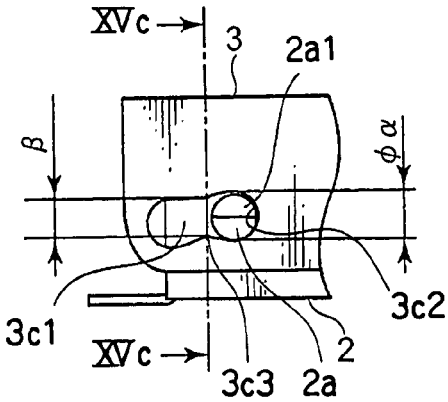
FIG. 15B is a side view of the connector corresponding to FIG. 15A.
Figure 15E:
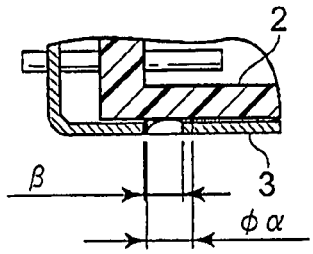
FIG. 15E is a sectional view taken along line XVe-XVe in FIG. 15D.
Figure 15C:
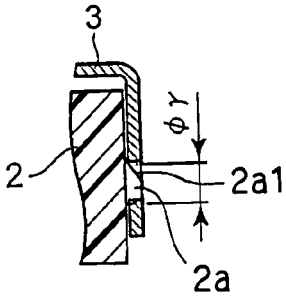
FIG. 15C is a sectional view taken along line XVc-XVc in FIG. 15B.

Subsequently, when the cover 3 is caused to slide in a direction of arrow A3 shown at (d) in FIG. 14A, the elongated holes 3*c* of the cover 3 are guided by the shaft portions 2*a* of the housing 2. Then, as also shown in FIG. 14C, the to-be-locked portions 3*b* of the cover 3 engage the locking portions 2*b* of the housing 2. In this event, the to-be-locked portions 3*b* of the cover 3 slidably contact the contact strips 2*d*4 of the ground terminal 2*d*.

As a result, the shell 11*b* of the optical module 11 is electrically connected to the board through the cover 3 and the ground terminal 2*d* so as to be grounded.

Referring to FIGS. 15A to 15E, a description will be given of the rotational engagement structure formed by the elongated holes 3*c* of the cover 3 and the shaft portions 2*a* of the housing 2.

Each elongated hole 3*c* of the cover 3 has a first hole 3*c*1, a second hole 3*c*2, and a connecting portion 3*c*3 connecting both holes 3*c*1 and 3*c*2 to each other and is gourd-shaped on the whole. Each shaft portion 2*a* of the housing 2 has a front end surface formed with a chamfered portion 2*a*1 in about a half region thereof.

Given that an original shaft diameter (before the formation of the chamfered portion 2*a*1) of the shaft portion 2*a* is $\alpha$, a substantial shaft diameter of the shaft portion 2*a* when the cover 3 is turned with the shaft portion 2*a* fitted in the elongated hole 3*c* is $\gamma$, and a dimension of the narrowest portion of the elongated hole 3*c* is $\beta$, these dimensions are set so as to satisfy a relationship of $\alpha>\beta\geqq\gamma$ by the formation of the chamfered portion 2*a*1. With this relationship, the cover 3 can be smoothly opened and closed, the cover 3 does not uselessly move downward at its opened position, and the cover 3 is easily locked to the housing 2 while is not uselessly unlocked from the housing 2.

Since the low contact pressure connector 4 placed in the socket connector 1 is substantially the same as that shown in FIG. 9, explanation thereof is omitted. Further, since the manner of using the socket connector 1 and the path from the optical module 11 to the low contact pressure connector 4 are the same as those in the first exemplary embodiment, explanation thereof is also omitted.

Figure 16:
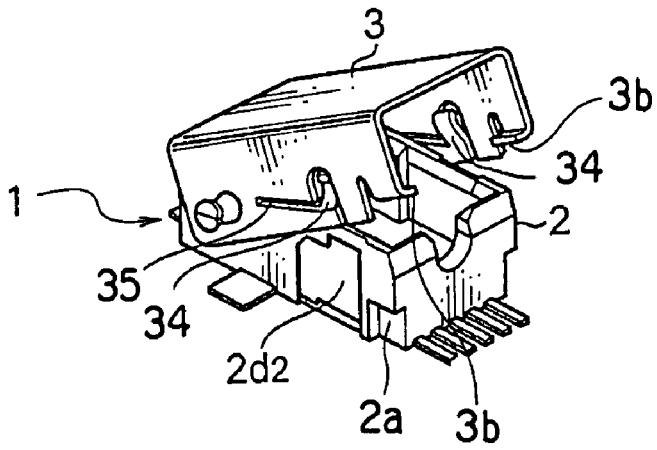
FIG. 16 is a perspective view showing a modification of the connector.

Referring to FIG. 16, a modification of the socket connector 1 will be described. The same reference symbols are assigned to the same portions, thereby omitting explanation thereof.

In the socket connector 1 of FIG. 16, both side walls of a cover 3 are formed with contact portions 34, respectively. Each contact portion 34 is formed by cutting and raising inward a portion of the side wall of the cover 3. For improving the flexibility, a slit 35 is formed in each side wall of the cover 3 so as to extend from one end of the root of the contact portion 34. When the cover 3 is closed, the contact portions 34 contact contact portions 2*d*2 of a ground terminal 2*d*, respectively.

Figure 17:
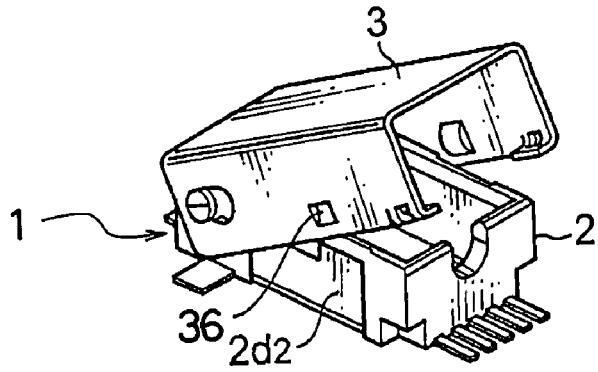
FIG. 17 is a perspective view showing another modification of the connector.

Referring to FIG. 17, another modification of the socket connector 1 will be described. The same reference symbols are assigned to the same portions, thereby omitting explanation thereof.

In the socket connector 1 of FIG. 17, both side walls of a cover 3 are formed with contact portions 36 projecting inward, respectively. The contact portions 36 correspond to the contact portions 32 of the socket connector 1 according to the first exemplary embodiment.

Figure 18B:
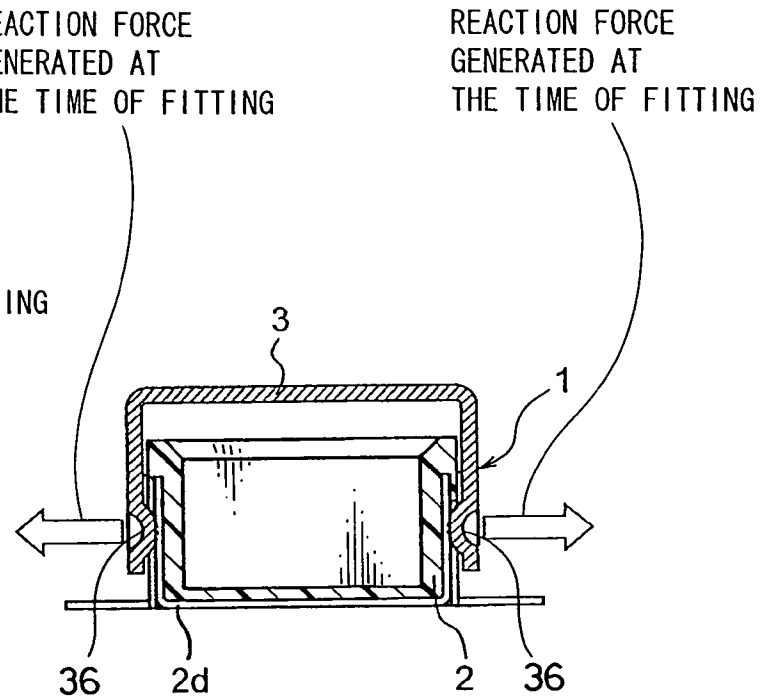
FIG. 18B is a sectional view taken along line XVIIIb-XVIIIb in FIG. 18A.
Figure 18A:
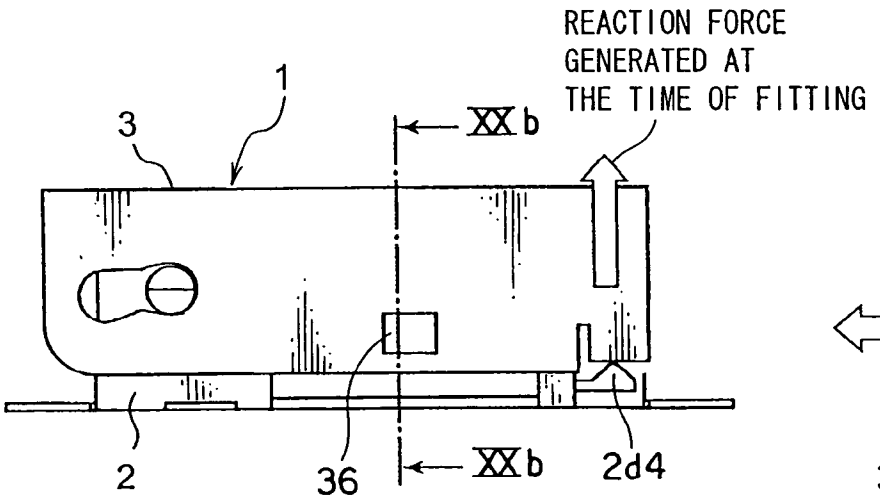
FIG. 18A is a side view of the modification shown in FIG. 17.

As a result, as shown in FIGS. 18A and 18B, since the contact between the ground terminal 2*d* and the cover 3 in the connected state is ensured by reaction forces generated in two directions, i.e. vertical and horizontal directions, at the time of the fitting thereof, the shell 11*b* of the optical module 11 is reliably grounded.

Figure 19:
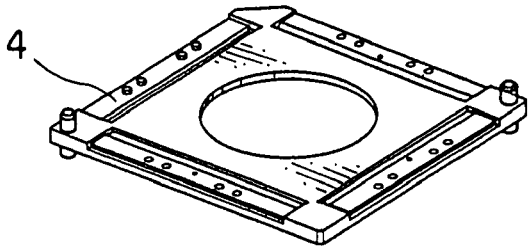
FIG. 19 is a perspective view showing a modification of the low contact pressure connector.

When a fitting object is a QFP (Quad Flat Package), a CMOS (Complementary Metal Oxide Semiconductor), or an LGA (Land Grid Array), use can be made of a low contact pressure assembly including a low contact pressure connector 4 on each of four sides as shown in FIG. 19.

Figure 20A:
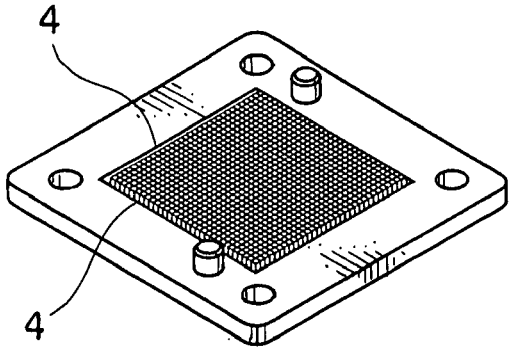
FIG. 20A is a perspective view showing another modification of the low contact pressure connector.
Figure 20B:
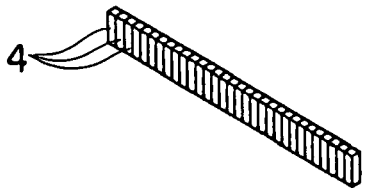
FIG. 20B is an enlarged perspective view of a portion of the modification shown in FIG. 20A.

As shown in FIGS. 20A and 20B, use may also be made of a low contact pressure assembly including a large number of low contact pressure connectors 4 arranged longitudinally and laterally.

Figure 21:
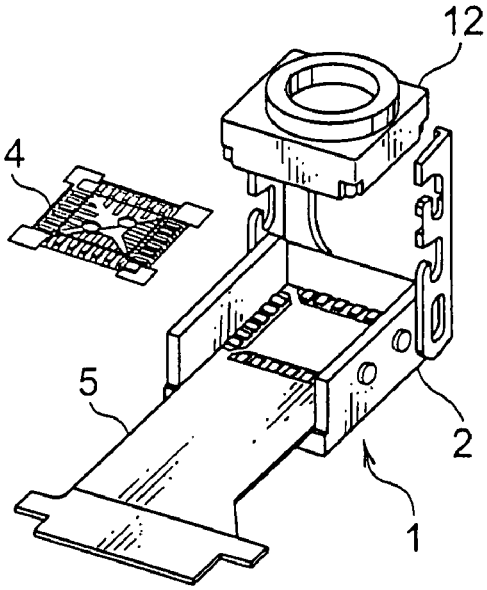
FIG. 21 is an exploded perspective view of a connector according to a third exemplary embodiment of this invention.

As a socket connector 1 in the case where a fitting object is a CMOS 12, it may be configured such that, as shown in FIG. 21, an FPC 5 is set in a housing 2 along with a low contact pressure connector 4. In this case, the low contact pressure connector 4 may be in the form of a film.

Figure 22:
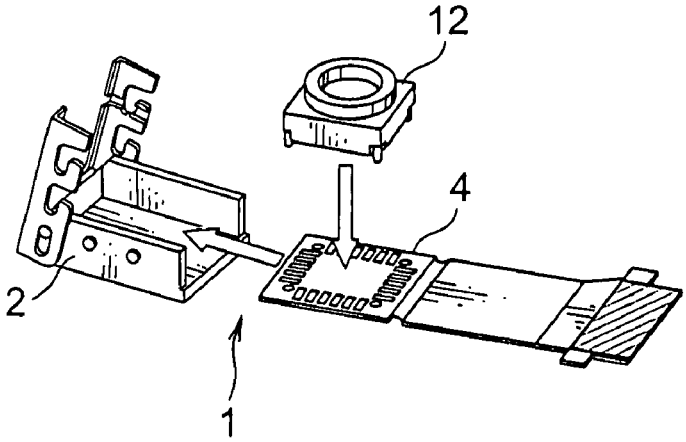
FIG. 22 is an exploded perspective view of a connector according to a fourth exemplary embodiment of this invention.

When a low contact pressure connector 4 is in the form of a film, a socket connector 1 may be configured such that, as shown in FIG. 22, a CMOS 12 is set in a housing 2 along with the low contact pressure connector 4.

While the present invention has thus far been described in connection with a few embodiments thereof, it will readily be possible for those skilled in the art to put this invention into practice in various other manners. For example, the elongated holes or shaft holes may be formed on the housing, while guide pins or shaft portions may be provided on the cover.

What is claimed is:

1. A connector for connection to a connection object, comprising:

a first contact;

a second contact;

a housing holding the first contact and the second contact; and a cover adapted to push the connection object toward the first contact, wherein the first contact comprises a first contact portion adapted to be connected to a contact portion of the connection object, wherein the second contact comprises a second contact portion and a locking portion, wherein the cover comprises:

a cover contact portion held by the housing so as to be rotatable between an opened position and a closed position and adapted to be connected to a shell of the connection object;

a connecting portion adapted to be connected to the second contact portion of the second contact; and a to-be-locked portion adapted to engage the locking portion of the second contact, and wherein, at the time of the connection to the connection object, the shell of the connection object and the second contact are connected to each other through the cover contact portion, the connecting portion, and the to-be-locked portion of the cover.

2. The connector according to claim 1, further comprising a relay member configured to obtain a contact pressure by a reaction force of an elastic body, wherein the contact portion of the connection object is electrically connected to the first contact portion of the first contact through the relay member.

3. The connector according to claim 2, wherein the relay member comprises:

a center plate disposed in the housing;

a pair of elastic members disposed on front and back surfaces of the center plate, respectively;

an insulating sheet surrounding the center plate along with the pair of elastic members; and a conductive terminal extending along a surface of the insulating sheet at least between positions corresponding to the pair of elastic members.

4. The connector according to claim 3, wherein the relay member further comprises a pair of insulating plates sandwiching therebetween the insulating sheet and the center plate at a position offset from the pair of elastic members.

5. The connector according to claim 3, further comprising an additional pair of elastic members respectively disposed on the front and back surfaces of the center plate at a distance from the pair of elastic members, wherein the insulating sheet further surrounds the additional pair of elastic members.

6. The connector according to claim 1, wherein the connector is adapted to be mounted on a board, the first contact comprises a first terminal portion for connection to the board, the second contact comprises a second terminal portion for connection to the board, and the shell of the connection object is adapted to be connected to ground of the board.

7. The connector according to claim 1, wherein the cover is rotated to the closed position and then caused to slide, so that the locking portion and the to-be-locked portion engage each other.

8. A connector for connection to a connection object, comprising:

a contact;

a housing holding the contact;

a cover adapted to push the connection object toward the contact; and a locking portion for locking the cover, wherein the cover is held by the housing so as to be rotatable between an opened position and a closed position and comprises a to-be-locked portion that engages the locking portion when the cover is rotated to the closed position and then caused to slide, wherein one of the housing and the cover comprises a shaft portion and the other of the housing and the cover comprises a shaft hole inserted with the shaft portion, wherein the shaft portion is cylindrical in shape and has a chamfered portion, wherein the shaft hole comprises:

a first hole that serves for rotation of the cover and is inserted with the shaft portion;

a second hole that is inserted with the shaft portion when the cover is caused to slide; and a connecting portion connecting the first hole and the second hole to each other and having a width smaller than either of a diameter of the first hole and a diameter of the second hole, and wherein the connecting portion inhibits movement of the cover when the cover is at the opened position, while allows the cover to slide cooperatively with the chamfered portion when the cover is at the closed position.

9. The connector according to claim 8, further comprising a relay member configured to obtain a contact pressure by a reaction force of an elastic body, wherein a contact portion of the connection object is electrically connected to a contact portion of the contact through the relay member.

10. The connector according to claim 9, wherein the relay member comprises:

a center plate disposed in the housing;

a pair of elastic members disposed on front and back surfaces of the center plate, respectively;

an insulating sheet surrounding the center plate along with the pair of elastic members; and a conductive terminal extending along a surface of the insulating sheet at least between positions corresponding to the pair of elastic members.

11. The connector according to claim 10, wherein the relay member further comprises a pair of insulating plates sandwiching therebetween the insulating sheet and the center plate at a position offset from the pair of elastic members.

12. The connector according to claim 10, further comprising an additional pair of elastic members respectively disposed on the front and back surfaces of the center plate at a distance from the pair of elastic members, wherein the insulating sheet further surrounds the additional pair of elastic members.

* * * * *